US009745863B2

(12) United States Patent
Ishibashi et al.

(10) Patent No.: US 9,745,863 B2
(45) Date of Patent: Aug. 29, 2017

(54) METHOD OF MANUFACTURING ROTARY MACHINE, METHOD OF PLATING ROTARY MACHINE, AND ROTARY MACHINE

(71) Applicant: MITSUBISHI HEAVY INDUSTRIES COMPRESSOR CORPORATION, Tokyo (JP)

(72) Inventors: Yusuke Ishibashi, Tokyo (JP); Yuya Konno, Tokyo (JP); Yujiro Watanabe, Tokyo (JP); Toyoaki Yasui, Tokyo (JP); Kazunari Tanaka, Tokyo (JP); Kosei Kawahara, Tokyo (JP); Yohei Fuchigami, Tokyo (JP); Toshio Nishina, Saitama (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 177 days.

(21) Appl. No.: 14/417,719

(22) PCT Filed: Nov. 26, 2013

(86) PCT No.: PCT/JP2013/081810
§ 371 (c)(1),
(2) Date: Jan. 27, 2015

(87) PCT Pub. No.: WO2014/103595
PCT Pub. Date: Jul. 3, 2014

(65) Prior Publication Data

US 2015/0267559 A1 Sep. 24, 2015

(30) Foreign Application Priority Data

Dec. 28, 2012 (JP) ..... 2012-288536

(51) Int. Cl.
*F01D 25/00* (2006.01)
*F01D 25/24* (2006.01)
(Continued)

(52) U.S. Cl.
CPC ..... *F01D 25/24* (2013.01); *C23C 18/1616* (2013.01); *C23C 18/1619* (2013.01);
(Continued)

(58) Field of Classification Search
CPC ..... F01D 25/005; F01D 25/24; F04D 17/122; F04D 29/4206; F04D 29/023;
(Continued)

(56) References Cited

U.S. PATENT DOCUMENTS 1,794,487 A 3/1931 Schwartz
3,709,715 A 1/1973 Edmunds et al.
(Continued)

FOREIGN PATENT DOCUMENTS

CN 1065907 A 11/1992
DE 19816325 A1 10/1999
(Continued)

OTHER PUBLICATIONS

International Search Report, issued in PCT/JP2013/081810, mailed Jan. 14, 2014.
(Continued)

*Primary Examiner* — Igor Kershteyn
(74) *Attorney, Agent, or Firm* — Birch, Stewart, Kolasch & Birch, LLP

(57) ABSTRACT

Provided is a method of manufacturing a rotary machine, which includes: a casing forming process of forming a casing of the rotary machine that has multiple opening parts and suctions and discharges a fluid; a surface activating process of supplying a pretreatment liquid into the casing, then discharging the pretreatment liquid from the casing
(Continued)

through the opening parts, and activating an inner surface of the casing after the casing forming process; a plating process of performing supply and discharge of a plating liquid into and from the easing through the opening parts to circulate the plating liquid and plating the inner surface of the casing after the surface activating process; and an assembling process of providing a rotating body that is rotatable relative to the casing so as to he covered from an outer circumference side by the casing plated in the plating process.

14 Claims, 10 Drawing Sheets

(51) Int. Cl.

| | |
|---|---|
| ***F04D 29/02*** | (2006.01) |
| ***F04D 29/42*** | (2006.01) |
| ***C23C 18/16*** | (2006.01) |
| ***C23C 18/18*** | (2006.01) |
| ***F04D 17/12*** | (2006.01) |
| ***C23C 18/44*** | (2006.01) |
| *C23C 18/32* | (2006.01) |

(52) U.S. Cl.
CPC ..... *C23C 18/1633* (2013.01); *C23C 18/1675* (2013.01); *C23C 18/1678* (2013.01); *C23C 18/18* (2013.01); *C23C 18/1817* (2013.01); *C23C 18/44* (2013.01); *F01D 25/005* (2013.01); *F04D 17/122* (2013.01); *F04D 29/023* (2013.01); *F04D 29/4206* (2013.01); *C23C 18/1605* (2013.01); *C23C 18/1692* (2013.01); *C23C 18/32* (2013.01); *F05D 2230/90* (2013.01); *Y10T 29/49323* (2015.01)

(58) Field of Classification Search
CPC ..... F05D 2230/90; C23C 18/1616; C23C 18/1619; C23C 18/1675; C23C 18/1633; C23C 18/18; C23C 18/1678; C23C 18/1817; C23C 18/44; C23C 18/32; C23C 18/1605; C23C 18/1692; Y10T 29/49323
See application file for complete search history.

(56) References Cited

U.S. PATENT DOCUMENTS

| | | | | |
|---|---|---|---|---|
| 4,002,778 | A | 1/1977 | Bellis et al. | |
| 4,227,986 | A | 10/1980 | Loqvist et al. | |
| 5,527,445 | A * | 6/1996 | Palumbo | C25D 5/18 205/103 |
| 5,545,433 | A | 8/1996 | Aanestad | |
| 7,449,098 | B1 * | 11/2008 | Mayer | B23H 5/08 205/118 |
| 2001/0036404 | A1 * | 11/2001 | Nagaoka | F04D 29/2216 415/199.4 |
| 2009/0324405 | A1 * | 12/2009 | Yasui | C23C 18/1651 415/217.1 |
| 2012/0207592 | A1 | 8/2012 | Tsutsui | |

FOREIGN PATENT DOCUMENTS

| | | | |
|---|---|---|---|
| JP | 2-50986 | B2 | 11/1990 |
| JP | 6-33891 | A | 2/1994 |
| JP | 8-178585 | A | 7/1996 |
| JP | 8-319576 | A | 12/1996 |
| JP | 2000-34991 | A | 2/2000 |
| JP | 2007-197766 | A | 8/2007 |
| JP | 2008-127598 | A | 6/2008 |
| JP | 2009-112946 | A | 5/2009 |
| WO | WO 2006/126993 | A1 | 11/2006 |

OTHER PUBLICATIONS

Written Opinion of the International Search Report, issued in PCT/JP2013/081810, mailed Jan. 14, 2014.
Chinese Office Action and Search Report, dated Feb. 3, 2016, for Chinese Application No. 201380039322,0, together with an English translation.
Japanese Office Action mailed Dec. 1, 2015 in counterpart application No. JP 2012-288536 with an English Translation.
Extended European Search Report, dated Aug. 3, 2016, for European Application No. 13867683.8.
Japanese Notice of Allowance, dated Jul. 12, 2016, for Japanese Application No. 2012-288536, together with an English translation thereof.
"Practical Techniques of Corrosion Protection (Compilation of Data of Application Technology on Plastics, Paints, Water Treatment, Chemical Cleaning) (Second volume)," published for Chemical Anticorrosion, Oct. 1995, pp. 705-719 (Total 18 pages).
Chinese Office Action and Chinese Search Report, issued Oct. 14, 2016, for Chinese Application No. 201380039322.0, along With English translations.
Lowenheim, "Modern Electroplating," Third Edition, China Machine Press, published Sep. 1982, pp. 410-412 (Total 6 pages).

* cited by examiner

METHOD OF MANUFACTURING ROTARY MACHINE, METHOD OF PLATING ROTARY MACHINE, AND ROTARY MACHINE

TECHNICAL FIELD

The present invention relates to plating work performed on an inner surface of a casing in manufacturing a rotary machine.

Priority is claimed on Japanese Patent Application No. 2012-288536, filed on Dec. 28, 2012, the contents of which are incorporated herein by reference.

BACKGROUND ART

For example, a rotary machine such as a centrifugal compressor or a turbine is provided with a casing that covers rotating bodies such as a rotary shaft and a blade set from an outer circumference side. Since an interior of the casing is exposed to a working fluid, plating is carried out on an inner surface of the casing as a measure against anticorrosion, for instance, when the working fluid is carbon dioxide Here, such plating work is typically done by immersing the casing in a plating liquid in a plating tank. Accordingly, a plating tank that has a large volume and is appropriate for the dimensions of the casing of the rotary machine is currently required, which inevitably leads to higher costs.

Incidentally, a plating method of sending a plating liquid into an interior of a long pipe under pressure and plating an inner surface of the long pipe without using a plating tank is disclosed in Patent Literature 1.

CITATION LIST

Patent Literature

[Patent Literature 1]

Japanese Unexamined Patent Application, First Publication No. H08-319576

SUMMARY OF INVENTION

Technical Problem

However, if the plating method of Patent Literature 1 is used, no plating tank is required, which leads to a reduction of costs. However, in addition to the fact that the dimensions are very large, the casing also has a complicated shape. Therefore, when application of the method of Patent Literature 1 to the plating work for the inner surface of the casing of the rotary machine is attempted, a huge device is required, and the plating work is not easy.

An object of the present invention is to provide a method of manufacturing a rotary machine, a method of plating the rotary machine, and the rotary machine, all of which enables plating work for a casing using a simple technique while reducing costs.

Solution to Problem

A method of manufacturing a rotary machine according to a first aspect of the present invention includes: a casing forming process of forming a casing of the rotary machine that has multiple opening parts and suctions and discharges a fluid; a surface activating process of supplying a pretreatment liquid into the casing, then discharging the pretreatment liquid from the casing through the opening parts, and activating an inner surface of the casing after the casing forming process; a plating process of performing supply and discharge of a plating liquid into and from the casing through the opening parts to circulate the plating liquid and plating the inner surface of the casing after the surface activating process; and an assembling process of providing a rotating body that is rotatable relative to the casing so as to be covered from an outer circumference side by the casing plated in the plating process.

According to this method of manufacturing the rotary machine, the inner surface of the casing is activated from the opening parts formed in the casing by the pretreatment liquid. Further, plating work is performed by circulation of the plating liquid. Since the multiple opening parts for suctioning and discharging the liquids are formed in the casing, the supply and discharge of the pretreatment liquid and the plating liquid can be performed using the multiple opening parts with no change in the surface activating process and the plating process. Accordingly, separate nozzles for supplying and discharging the pretreatment liquid and the plating liquid are not provided, and a plating tank for immersing the entire casing is not required either. As such, the plating work for the inner surface of the casing is possible.

Further, a method of manufacturing a rotary machine according to a second aspect of the present invention may further include a preheating process of supplying a pretreatment liquid into the casing, then discharging the pretreatment liquid from the casing through the opening parts, and preheating the casing between the surface activating process and the plating process in the first aspect.

Because this preheating process is provided, the plating tank for immersing the entire casing is not required, and the preheating before the plating work can be performed using the opening parts. Particularly, in the casing having a large size and a complicated shape, it takes time to raise a temperature by circulating the plating liquid. Further, an uneven temperature may be caused on the inner surface of the casing by partial immersion of the plating liquid. For this reason, it may be impossible to obtain a sufficient quality of plating. Due to the preheating liquid, such a problem can be avoided, and a quality of plating can be further improved.

Further, in a method of manufacturing a rotary machine according to a third aspect of the present invention, the casing in the preheating process in the second aspect may be preheated by a preheating liquid containing a reductant as the preheating liquid.

The preheating liquid containing such a reductant is used, and thereby it is possible to prevent an oxide thin film from forming at the inner surface of the casing which is a portion to be plated during the preheating. That is, the oxidation of the inner surface of the casing can be prevented, and the quality of plating can be further improved in the plating process.

Further, in a method of manufacturing a rotary machine according to a fourth aspect of the present invention, the plating liquid supplied into the casing in the plating process in any one of the first to third aspects may be stirred by a stirring device.

This stirring device is used, and thereby even in the casing having a large size and a complicated shape, a flow velocity of the plating liquid in the casing can be set to a numerical value most suitable for plating work. Further, by removing a gas that is generated during the plating work and is attached to the inner surface of the casing, it is possible to prevent the plating work from being obstructed at portions at which the gas is attached. Therefore, the quality of plating can be further improved in the plating process.

Further, in a method of manufacturing a rotary machine according to a fifth aspect of the present invention, in the plating process in any one of the first to fourth aspects, the plating may be performed in a state in which the opening part having a largest opening among the multiple opening parts is directed upward.

Thereby, the gas that is generated during the plating work and is attached to the inner surface of the casing can be easily discharged outside the casing. Therefore, the quality of plating can be further improved in the plating process.

Further, in a method of manufacturing a rotary machine according to a sixth aspect of the present invention, the plating liquid in the plating process in any one of the first to fifth aspects may be supplied and discharged from the opening part that requires plating work and suctions and discharges the fluid among the multiple opening parts.

Thereby, when the plating liquid is supplied and discharged, an inner surface of the opening part requiring the plating work can be plated at the same time. For this reason, the plating work can be performed on the casing in a more efficient way.

Further, in a method of manufacturing a rotary machine according to a seventh aspect of the present invention, in the plating process in any one of the first to sixth aspects, the plating may be performed in a state in which a cover member surrounding an opening edge of the opening part from an outer circumference side is provided for the casing so as to cause the opening part opened upward among the multiple opening parts to further extend in an upward direction.

Due to such a cover member, a liquid level of the plating liquid supplied into the casing can be at a higher position than the upper opening part. For this reason, the plating work can be performed up to an opening edge of the opening part, and the plating work can be reliably performed on the entire inner surface of the casing. Therefore, the quality of plating is further improved.

Further, in a method of manufacturing a rotary machine according to an eighth aspect of the present invention, in the plating process in any one of the first to seventh aspects, the plating may be performed after a core is installed in the casing in a state in which the core is spaced apart from an inner surface of the casing.

Because such a core is provided, an internal volume of the casing can be reduced, and a supplied amount of the plating liquid can be reduced, which leads to a reduction of costs. Further, a flow channel when the plating liquid circulates and flows in the casing is reduced, and a flow can be made smooth. Therefore, the quality of plating can be improved.

Further, in a method of manufacturing a rotary machine according to a ninth aspect of the present invention, in the plating process in the eighth aspects, a hollow member having through-holes that are formed in an outer circumferential surface thereof and communicate with an interior and exterior thereof may be used as the core, and the plating liquid may be supplied into the hollow member and be ejected from the through-holes toward an exterior of the hollow member.

Because the core of such a hollow member is used, the flow channel when the plating liquid circulates and flows in the casing is reduced, and the flow can be made smooth. Further, the plating liquid is ejected from the through-holes, and thereby a stirring effect can also be obtained. Accordingly, it is possible to make the flow velocity of the plating liquid in the casing uniform, and to remove the gas that is generated during the plating work and is attached to the inner surface of the casing. Therefore, the quality of plating can be improved in the plating process.

Further, in a method of manufacturing a rotary machine according to a tenth aspect of the present invention, in the plating process in the eighth or ninth aspect, the plating may be performed while moving the core.

Thereby, it is possible to obtain an effect of stirring the plating liquid, to optimize the flow velocity of the plating liquid, and to remove the gas. Therefore, the quality of plating can be further improved in the plating process.

Further, in a method of manufacturing a rotary machine according to an eleventh aspect of the present invention, in the plating process in any one of the first to tenth aspects, the plating may be performed in a state in which a partition plate for partitioning an interior of the casing into multiple spaces in an extending direction of the casing is provided such that at least two of the opening parts communicate with the respective spaces.

Thereby, the internal space of the casing in which the plating liquid circulates can be finely divided, and the plating liquid can flow through each space. Therefore, fluidity of the plating liquid in the casing can be improved, and the quality of plating can be improved.

Further, in a method of manufacturing a rotary machine according to a twelfth aspect of the present invention, in the plating process in any one of the first to eleventh aspects, the plating may be performed while vibration is imparted to the casing by a vibration imparting device.

Thereby, it is possible to prevent retention of the gas that is generated during the plating work and is attached to the inner surface of the casing. As such, the quality of plating can be further improved in the plating process.

Further, in a method of manufacturing a rotary machine according to a thirteenth aspect of the present invention, in the plating process in any one of the first to twelfth aspects, the plating may be performed while the inner surface of the casing is rubbed by a brush.

Thereby, it is possible to prevent retention of the gas that is generated during the plating work and is attached to the inner surface of the casing, and to further improve the quality of plating in the plating process.

Further, a rotary machine according to a fourteenth aspect of the present invention is manufactured by the method according to any one of the first to thirteenth aspects.

According to this rotary machine, the supply and discharge of the pretreatment liquid and the plating liquid can be performed using the multiple opening parts with no change in the surface activating process and the plating process. Accordingly, the separate nozzles for supplying and discharging the pretreatment liquid and the plating liquid are not provided. Further, as the plating tank for immersing the entire casing is not required either, the plating work for the inner surface of the casing is possible.

Further, a method of plating a rotary machine according to a fifteenth aspect of the present invention includes, to plate an inner surface of a casing of the rotary machine that has multiple opening parts and suctions and discharges a fluid, a surface activating process of supplying and discharging a pretreatment liquid into and from the casing through the opening parts and activating the inner surface of the casing, and a plating process of performing supply and discharge of a plating liquid into and from the casing through the opening parts to circulate the plating liquid and plating the inner surface of the casing after the surface activating process.

According to this method of plating the rotary machine, the separate nozzles for supplying and discharging the pretreatment liquid and the plating liquid are not provided. Further, as the plating tank for immersing the entire casing is not required, the plating work for the inner surface of the casing is possible.

Further, a rotary machine according to a sixteenth aspect of the present invention is manufactured by the method according to the fifteenth aspect.

According to this rotary machine, the rotary machine can be manufacture by the plating method of performing the plating work on the inner surface of the casing while the separate nozzles for supplying and discharging the pretreatment liquid and the plating liquid are not provided, and the plating tank for immersing the entire casing is not required.

Advantageous Effects of Invention

According to the method of manufacturing a rotary machine, the method of plating the rotary machine, and the rotary machine, the pretreatment liquid and the plating liquid are supplied and discharged using the opening parts formed in the casing. Thereby, a cost can be reduced, and plating work of the casing can be performed by a simple technique.

DESCRIPTION OF EMBODIMENTS

[First Embodiment]

Hereinafter, a method of manufacturing a centrifugal compressor (rotary machine) 100 according to a first embodiment of the present invention will be described.

The centrifugal compressor 100 manufactured by the present embodiment is a device that takes in a fluid F, circulates the fluid F along an axis O, and thereby raises a pressure of the fluid F.

Figure 1:
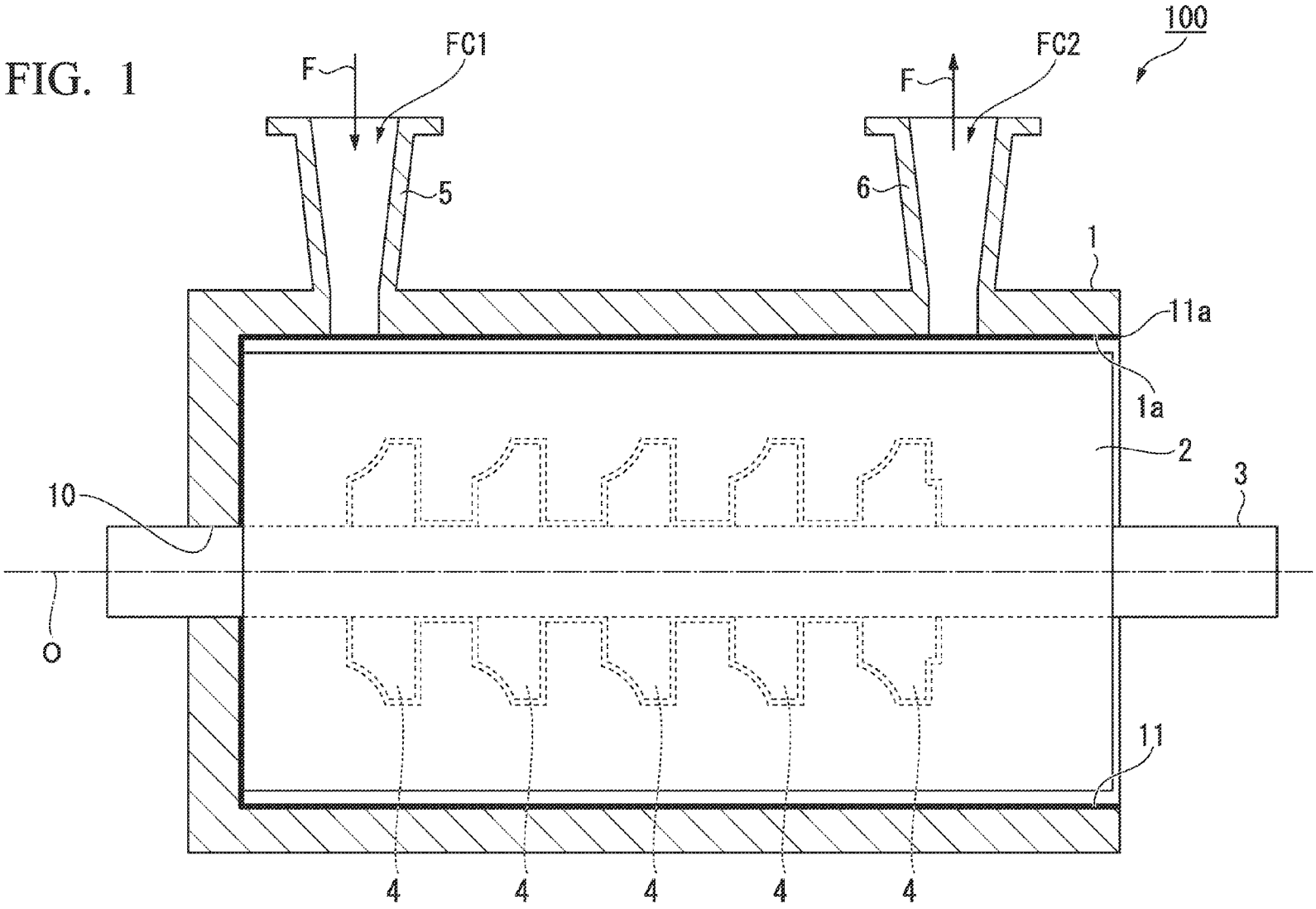
FIG. 1 is a schematic cross-sectional view illustrating a centrifugal compressor manufactured by a method of manufacturing the centrifugal compressor according to a first embodiment of the present invention.

As illustrated in FIG. 1, the centrifugal compressor 100 includes a casing 1 having a cylindrical shape, an internal casing 2 that is adapted to be covered from an outer circumference side thereof by the casing 1 and is provided so as not to be relatively rotatable with respect to the casing 1, a rotary shaft (rotating body) 3 and an impeller (rotating body) 4 that are covered from an outer circumference side thereof by the internal casing 2 and are provided so as to be relatively rotatable with respect to the internal casing 2.

The rotary shaft 3 has a columnar shape whose center is an axis O, and extends in a direction of the axis O. Further, the impeller 4 has multiple stages that are fit onto the rotary shaft 3 at predetermined intervals in the direction of the axis O and are rotated about the axis O along with the rotary shaft 3.

The internal casing 2 supports the rotary shaft 3 and the impeller 4. Further, a channel (not shown) is formed between the stages of the impeller 4 in the internal casing 2, and the fluid F is gradually circulated from the foremost stage to the rearmost stage of the impeller 4 via the channel and is increased in pressure.

The casing 1 has a cylindrical shape whose center is the axis O and in which an upstream opening part 10 of one side in the direction of the axis O (left side in the space of FIG. 1) and a downstream opening part 11 of the other side are formed, and takes an external form of the centrifugal compressor 100. In the present embodiment, the casing 1 is shaped to protrude toward a radial inner side of the axis O in an annular shape at an end of one side in the direction of the axis O. Thereby, in comparison with the downstream opening part 11, the upstream opening part 10 is adapted to have a smaller diameter.

The casing 1 has an intake port (opening part) 5 of the fluid F which is provided at the end of one side serving as an upstream side in the direction of the axis O, and a discharge port (opening part) 6 of the fluid F which is provided at the end of the other side so as to protrude from an outer circumferential surface thereof toward a radial outer side of the axis O. In the present embodiment, the casing 1 is one cylindrical member without a division plane.

The intake port 5 is formed with an intake channel FC1 that passes through the casing 1 in a radial direction of the axis O so as to communicate with the interior and exterior of the casing 1. The intake channel FC1 is adapted to communicate with an interior of the foremost-stage impeller 4, to take in the fluid F from the outside, and to allow the fluid F to flow into this impeller 4.

The discharge port 6 is formed with a discharge channel FC2 that passes through the casing 1 in the radial direction of the axis O so as to communicate with the interior and exterior of the casing 1. The discharge channel FC2 is adapted to communicate with an interior of the rearmost-stage impeller 4, and to be able to discharge the fluid F from this impeller 4 to the outside.

Next, with regard to a manufacturing method (including a plating method) of the centrifugal compressor 100, first, an outline of manufacturing processes will be given, and then details of each process will be described.

Figure 2:
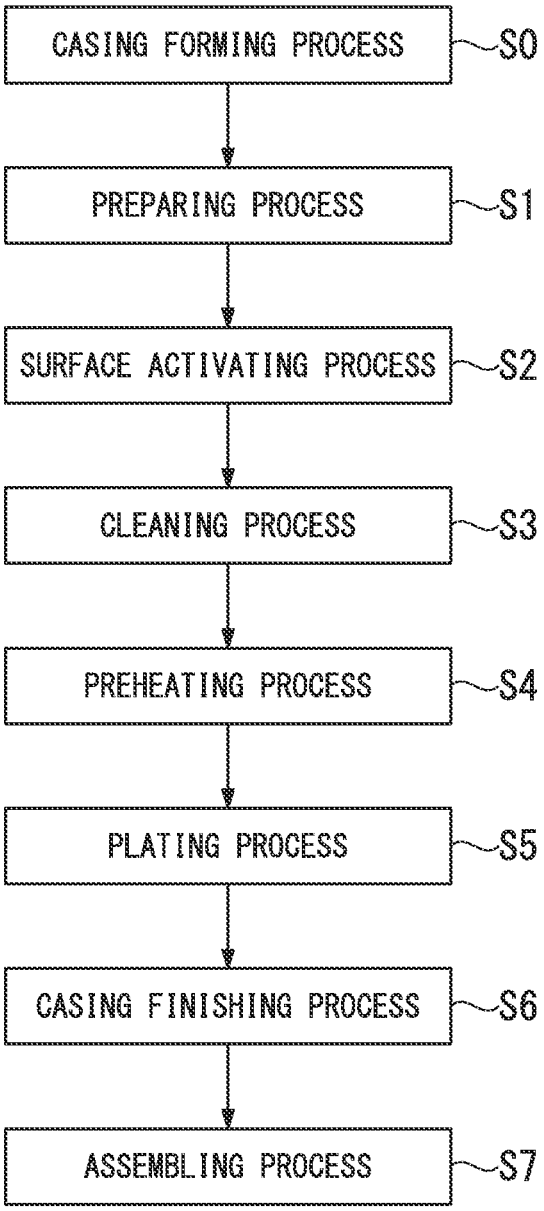
FIG. 2 is a flow chart illustrating a procedure of the method of manufacturing the centrifugal compressor according to the first embodiment of the present invention.

As illustrated in FIG. 2, the manufacturing method of the centrifugal compressor 100 includes a casing forming process S0 of forming the casing 1, a preparing process S1 of preparing plating work for the inner surface 1*a* of the casing 1 after the casing forming process S0, and a surface activating process S2 of supplying a pretreatment liquid W1 into the casing 1 after the preparing process S1 and activating the inner surface 1*a* of the casing 1.

Further, the manufacturing method of the centrifugal compressor 100 includes a cleaning process S3 of cleaning the interior of the casing 1 after the surface activating process S2, a preheating process S4 of supplying a preheating liquid W2 into the casing 1 and preheating the casing 1 after the cleaning process S3, a plating process S5 of supplying a plating liquid W3 into the casing 1 and plating the inner surface 1*a* of the casing 1 after the preheating process S4, and a casing finishing process S6 of finishing the casing 1 after the plating process S5.

Then, the manufacturing method of the centrifugal compressor 100 includes an assembling process S7 of incorporating the internal casing 2, the rotary shaft 3, and the impeller 4 into the casing 1 after the casing finishing process S6. The final centrifugal compressor 100 is manufactured via these processes.

First, the casing forming process S0 is carried out. In detail, a cylindrical casing 1 is formed using machining such as casting.

Next, the preparing process S1 is carried out. In detail, masking is performed on an unnecessary plating portion of the casing 1. Afterwards, the casing 1 is placed such that the direction of the axis O is identical to a vertical direction and the intake port 5 is disposed downward. Since the downstream opening part 11 is placed upward at this point in time, among the intake port 5, the discharge port 6, the upstream opening part 10, and the downstream opening part 11 that are all the opening parts in the casing 1, the largest opening part is directed upward.

Figure 3:
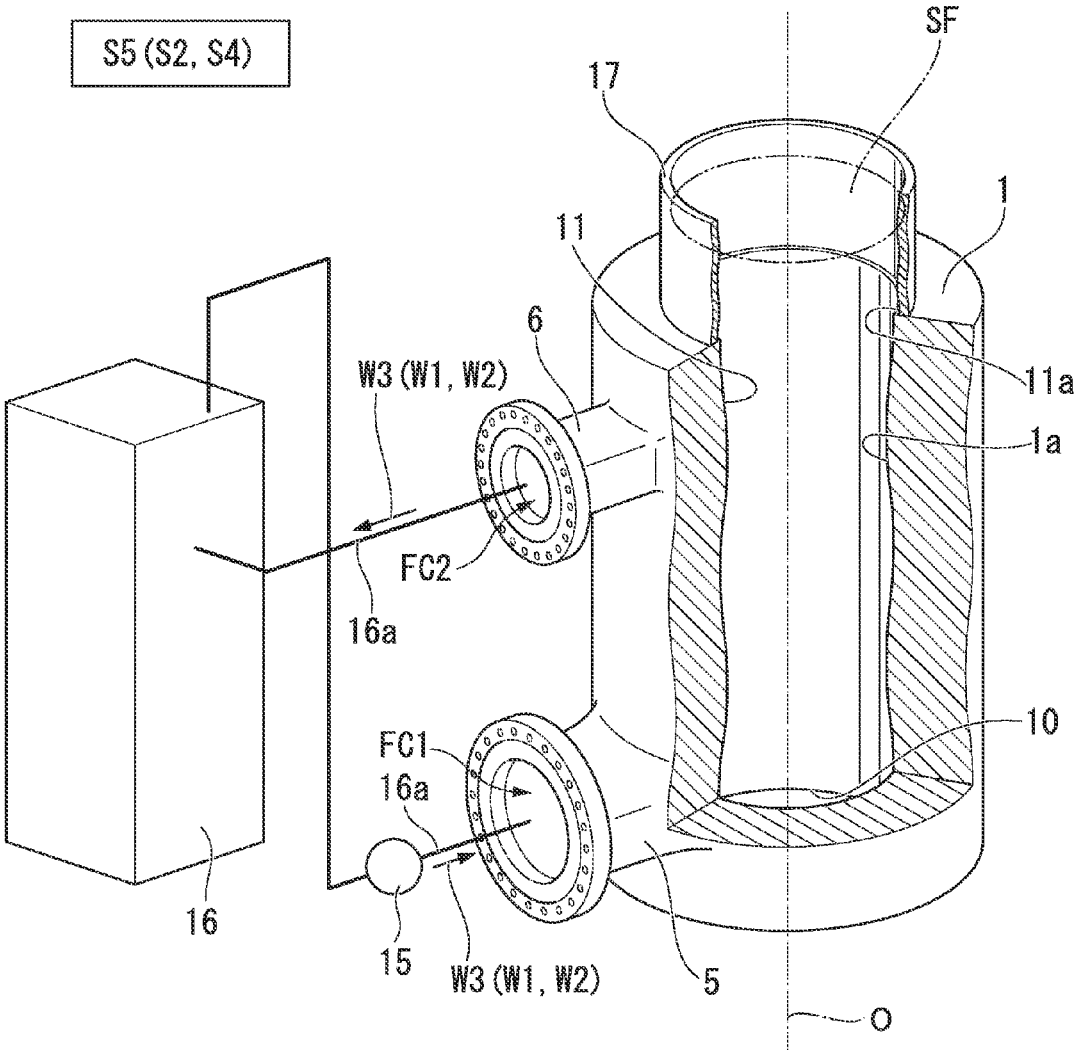
FIG. 3 is a perspective view illustrating an aspect of carrying out plating on a casing using the method of manufacturing the centrifugal compressor according to the first embodiment of the present invention.

In the preparing process S1, the upstream opening part 10 is additionally covered to prevent a liquid from leaking from the upstream opening part 10. In addition, a pump 15 and a tank 16 (see FIG. 3) are installed to connect pipings 16*a* to the intake port 5 and the discharge port 6.

Although details of the tank 16 are not illustrated, three kinds of liquids, i.e. the pretreatment liquid W1, the preheating liquid W2, and the plating liquid W3, are adapted to each be stored separately. Then, the liquid used in each process is separately supplied into the casing 1 via the piping 16*a*. Further, the liquids discharged from the interior of the casing 1 are adapted to be recovered, via the piping 16*a*. Further, a pH value, a concentration, and a temperature of each liquid are properly adjusted so as to have predetermined values at all times.

In the preparing process S1, an alkaline solution is sprayed onto the inner surface 1*a* of the casing 1, and treatment such as degreasing is performed on the inner surface 1*a*. For example, as the alkaline solution, a mixture such as sodium hydroxide, a silicate, and a surfactant is used. After the treatment of the inner surface 1*a* is performed, flushing is performed by spraying water on the inner surface 1*a*.

Further, a cover member 17, which surrounds an opening edge 11*a* of the downstream opening part 11 from the outer circumference side so as to cause the downstream opening part 11 opened upward to further extend in an upward direction and has a cylindrical shape in which a space in which the liquid is collected is formed in an upper portion of the downstream opening part 11, is mounted on an upper portion of the casing 1. The cover member 17 may be fixed to the upper portion of the casing 1, or it may simply be placed on the upper portion of the casing 1, for instance, via a packing.

Next, the surface activating process S2 is performed. In detail, the pretreatment liquid W1 is supplied from the tank 16 to the intake port 5 by the pump 15, and the interior of the casing 1 is filled with the pretreatment liquid W1. In this case, it is preferable to decide a supplied amount of the pretreatment liquid W1 such that a liquid level SF of the stored pretreatment liquid W1 is located inside the cover member 17 or overflows over the cover member 17, and the liquid level SF preferably reaches the upper portion of the downstream opening part 11. Afterwards, the pretreatment liquid W1 is discharged from the discharge port 6 of the casing 1, is recovered to the tank 16, and removes an oxide film of the inner surface 1*a* of the casing 1 to activate the inner surface 1*a*.

As the pretreatment liquid W1, for example, an acid solution such as hydrochloric acid adjusted to room temperature is used.

The cleaning process S3 is performed after the surface activating process S2. In detail, flushing is performed on the inner surface 1*a* of the casing 1 which is activated by the pretreatment liquid W1 using a spray.

Next, the preheating process S4 is performed. In detail, with respect to the casing 1 flushed in the cleaning process S3, the preheating liquid W2 is supplied from the tank 16 to the intake port 5 by the pump 15, and the interior of the casing 1 is filled with the preheating liquid W2. Then, it is preferable to decide a supplied amount of the preheating liquid W2 such that a liquid level SF of the preheating liquid W2 stored in the casing 1 is located inside the cover member 17 or overflows over the cover member 17, and the liquid level SF preferably reaches the upper portion of the downstream opening part 11. Afterwards, the preheating liquid W2 is discharged from the discharge port 6 of the casing 1, is recovered in the tank 16, and raises a temperature of the casing 1 before the plating work.

As the preheating liquid W2, for example, an aqueous solution including a reductant adjusted to a temperature of about 90° C. is used. As the reductant, for example, sodium hypophosphite is used, but other typical reductants may be used.

Here, the flushing may be performed after the preheating process S4 has been performed.

Next, the plating process S5 is performed. In detail, with respect to the casing 1 preheated in the preheating process S4, the plating liquid W3 is supplied from the tank 16 to the intake port 5 by the pump 15, and the interior of the casing 1 is filled with the plating liquid W3. A supplied amount of the plating liquid W3 filling the casing 1 is decided such that a liquid level SF of the plating liquid W3 is located inside the cover member 17 or overflows over the cover member 17. Namely, the liquid level SF is adapted to reach the upper portion of the downstream opening part 11, and the casing 1 remains filled with the plating liquid W3 up to the uppermost portion thereof. In this state, the plating liquid W3 is discharged from the discharge port 6, and is recovered to the tank 16. In a state in which the interior of the casing 1 is filled with the plating liquid W3, the plating liquid W3 is circulated to plate the inner surface of the casing 1.

As the plating liquid W3, for example, an electroless nickel plating liquid W3 adjusted to a temperature of about 90° C. is used.

Next, the casing finishing process S6 is performed. In detail, the plated inner surface 1*a* of the casing 1 is flushed using a spray first, and then is dried, and the casing 1 is finished. Further, a baking treatment (hydrogen embrittlement removal) may be carried out.

Finally, the assembling process S7 is performed. In detail, the internal casing 2, the rotary shaft 3, and the impeller 4 are installed in the casing 1, and the centrifugal compressor 100 is manufactured.

In this manufacturing method of the centrifugal compressor 100, the pretreatment liquid W1 is supplied from the intake port 5 formed in the casing 1, and is discharged from the discharge port 6. Thereby, the inner surface 1*a* of the casing 1 is activated by the pretreatment liquid W1. Likewise, the preheating liquid W2 and the plating liquid W3 are supplied and discharged from the intake port 5 and the discharge port 6. Thereby, the plating work for the inner surface 1*a* of the casing 1 can be performed.

In detail, in the surface activating process S2 and the plating process S5, the supply and discharge of the pretreatment liquid W1 and the plating liquid W3 can be performed using the multiple opening parts with no change. Accordingly, separate nozzles for supplying and discharging these liquids are not provided, and a plating tank for immersing the entire casing 1 is not required either. As such, the plating work for the inner surface 1*a* of the casing 1 is possible.

Here, especially in the casing 1 having a large size and a complicated shape, it takes time to raise the temperature based on the circulation of the plating liquid W3. Further, the plating liquid W3 is partly immersed, and thereby unevenness in the temperature may occur at the inner surface 1*a* of the casing 1. For this reason, a sufficient quality of plating may not be obtained. In view of this, the preheating process S4 is performed before the plating process S5, and thereby a preheating tank for immersing the entire casing 1 is not required. As such, the temperature of the casing 1 can be uniformly raised. For this reason, a quality of plating can be further improved.

Further, in the preheating process S4, the preheating liquid W2 containing the reductant is used. Thereby, in the inner surface 1*a* of the casing 1 which is a portion to be plated, it is possible to prevent the oxide film from forming during the preheating. That is, it is possible to achieve the antioxidation of the inner surface 1*a* of the casing 1, and to further improve the quality of plating in the plating process S5.

Furthermore, the casing 1 is placed such that the downstream opening part 11 that is the largest opening part is directed upward, and the plating work is performed. For this reason, hydrogen gas that is generated during the plating work and is attached to the inner surface 1*a* of the casing 1 can be easily discharged outside the casing 1. Therefore, the quality of plating can be further improved in the plating process S5.

Thus, in the present embodiment, in the state in which the cover member 17 is provided upward and the space in which the liquid is collected is formed in an upper portion of the casing 1, each of the pretreatment liquid W1, the preheating liquid W2, and the plating liquid W3 is supplied into the casing 1. For this reason, the liquid level SF of the liquid supplied into the casing 1 is placed at a higher position than the downstream opening part 11, and the plating work can be performed up to the opening edge 11*a* of the downstream opening part 11. Accordingly, since the plating work can be reliably performed on the entire inner surface 1*a* of the casing 1, this leads to further improvement in the quality of plating. Each liquid overflowing from the upper portion of the cover member 17 is recovered to the tank 16 and is reused.

Further, since the plating liquid W3 is supplied from the intake port 5 and the discharge port 6 of the casing 1, inner surfaces 1*a* of the intake and discharge channels FC1 and FC2 can also be plated at the same time.

According to the manufacturing method of the centrifugal compressor 100 of the present embodiment, the pretreatment liquid W1 and the plating liquid W3 are supplied and discharged using the intake and discharge ports 5 and 6 formed in the casing 1. Thereby, costs are reduced, and the plating work for the inner surface 1*a* of the casing 1 can be performed in a simple way.

Here, in the present embodiment, the pretreatment liquid W1, the preheating liquid W2, and the plating liquid W3 are adapted to be supplied from the intake port 5 of the casing 1 and be discharged from the discharge port 6. However, without being limited to such an example, conversely, each liquid may be supplied from the discharge port 6 and be discharged from the intake port 5, or be supplied and discharged using the upstream opening part 10 and the downstream opening part 11. Further, in addition to the intake port 5, the discharge port 6, the upstream opening part 10, and the downstream opening part 11, each liquid may be supplied and discharged through other opening parts formed in the casing 1.

Incidentally, of the intake and discharge ports 5 and 6, the opening part from which high corrosion resistance is particularly required may be subjected to overlaying using a stainless steel material. Such an opening part requires no plating work. For this reason, as the pretreatment liquid W1, the preheating liquid W2, and the plating liquid W3 are supplied and discharged from the opening part from which the plating is required among the multiple opening parts, the plating work is performed on the inner surface 1*a* of the casing 1, and these opening parts can be plated. Therefore, the casing 1 can be more efficiently plated. For example, in a side stream type of compressor, since two intake ports 5 and one discharge port 6 are provided, the opening parts supplying and discharging the liquid can be appropriately selected from these intake ports 5 and the discharge port 6.

When there is a low possibility of unevenness in temperature occurring at the inner surface 1*a* of the casing 1 in view of a shape and size of the casing 1, the preheating process S4 may not necessarily be performed. Further, no reductant is contained in the preheating liquid W2 used in preheating process S4.

The supply of the plating liquid W3 may also be initiated before the preheating liquid W2 is completely discharged.

The casing 1 is placed in the state in which the downstream opening part 11 is directed upward, and each liquid is supplied and discharged. However, the casing 1 may be placed, for instance, such that the direction of the axis O becomes a horizontal direction, i.e. such that a direction in which the upstream opening part 10 and the downstream opening part 11 are open becomes a horizontal direction, and each liquid may be supplied and discharged.

In the preparing process S1, the cleaning process S3, and the casing finishing process S6, the interior of the casing 1 is flushed by the spray. Instead of this, similar to the surface activating process S2, the preheating process S4, and the plating process S5, water may be supplied and discharged using the intake port 5, the discharge port 6, the upstream opening part 10, and the downstream opening part 11, and the inner surface 1*a* of the casing 1 may be flushed. The same is true when the flushing is performed after the preheating process S4.

The cover member 17 may not necessarily be provided, and the surface activating process S2, the preheating process S4, and the plating process S5 may be performed by supplying each liquid such that each liquid overflows from the downstream opening part 11 opened upward.

[Second Embodiment]

Next, a method of manufacturing a centrifugal compressor 100 according to a second embodiment of the present invention will be described.

The same components as in the first embodiment will be given the same numerals or symbols, and detailed description thereof will be omitted.

In the present embodiment, a plating process S25 is different from that of the first embodiment.

Figure 4:
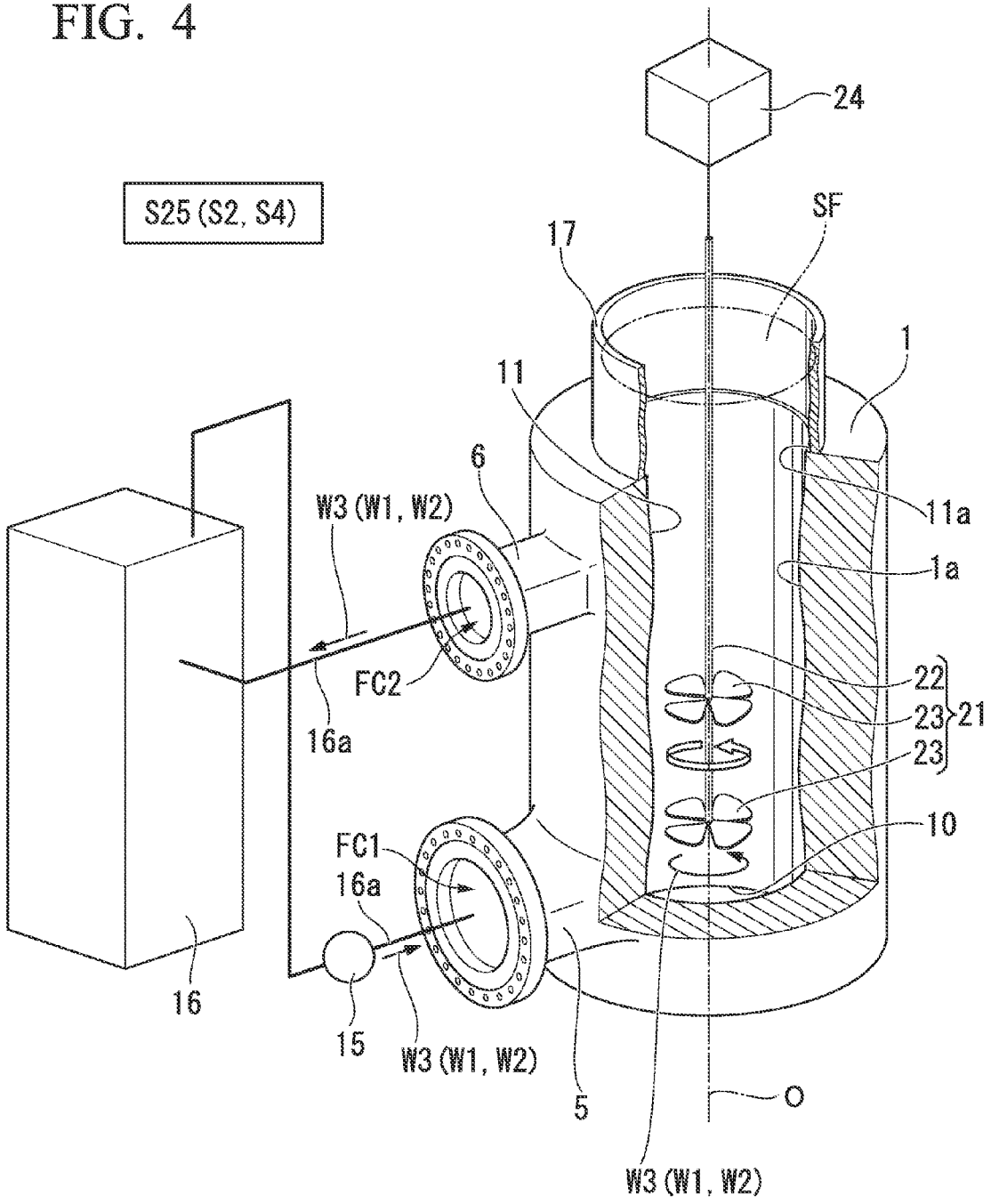
FIG. 4 is a perspective view illustrating an aspect of carrying out plating on a casing using a method of manufacturing a centrifugal compressor according to a second embodiment of the present invention.

As illustrated in FIG. 4, in the plating process S25, plating work is performed on an inner surface 1*a* of a casing 1 in a state in which a stirring propeller 21 acting as a stirring device is inserted from a downstream opening part 11.

The stirring propeller 21 has a body part 22 shaped of a rod extending in a direction of an axis O, blade parts 23 that are provided in one body so as to protrude to a radial outer side of the body part 22, i.e. so as to be directed to the inner surface 1*a* of the casing 1, and a driving part 24 such as an electric motor which clamps the body part 22 to provide a rotational force about the axis O.

In the plating process S25, a plating liquid W3 is circulated while the stirring propeller 21 is rotated and an interior of the casing 1 filled with the plating liquid W3 is stirred.

According to the method of manufacturing the centrifugal compressor 100 of the present embodiment, even in the case of the casing 1 that is large and has a complicated shape, the use of the stirring propeller 21 allows a flow velocity of the plating liquid W3 in the casing 1 to be set to a numerical value most suitable for plating work.

Further, hydrogen gas that is generated during the plating work and is attached to the inner surface 1*a* of the casing 1 is removed. Thereby, it is possible to prevent the plating work from being obstructed at portions at which the hydrogen gas is attached. For this reason, a quality of plating can be further improved in the plating process S25.

Here, another device may be used as the stirring device. Namely, the plating liquid W3 in the casing 1 can also be convected and stirred, for instance, by controlling a flow rate of the supplied or discharged plating liquid W3. To be specific, as a supplied amount of the plating liquid W3 from an intake port 5 is increased, and a discharged amount of the plating liquid W3 from the discharge port 6 is reduced, convection of the plating liquid W3 can be generated, and the foregoing effects can be obtained like the stirring propeller 21.

Further, the stirring propeller 21 can be applied to the plating process S25 as well as a surface activating process S2, a preheating process S4, a cleaning process S3, and so on. Thereby, the quality of plating can be further improved.

[Third Embodiment]

Next, a method of manufacturing a centrifugal compressor 100 according to a third embodiment of the present invention will be described.

The same components as in the first and second embodiments will be given the same numerals or symbols, and detailed description thereof will be omitted.

In the present embodiment, a plating process S35 is different from those of the first and second embodiments.

Figure 5:
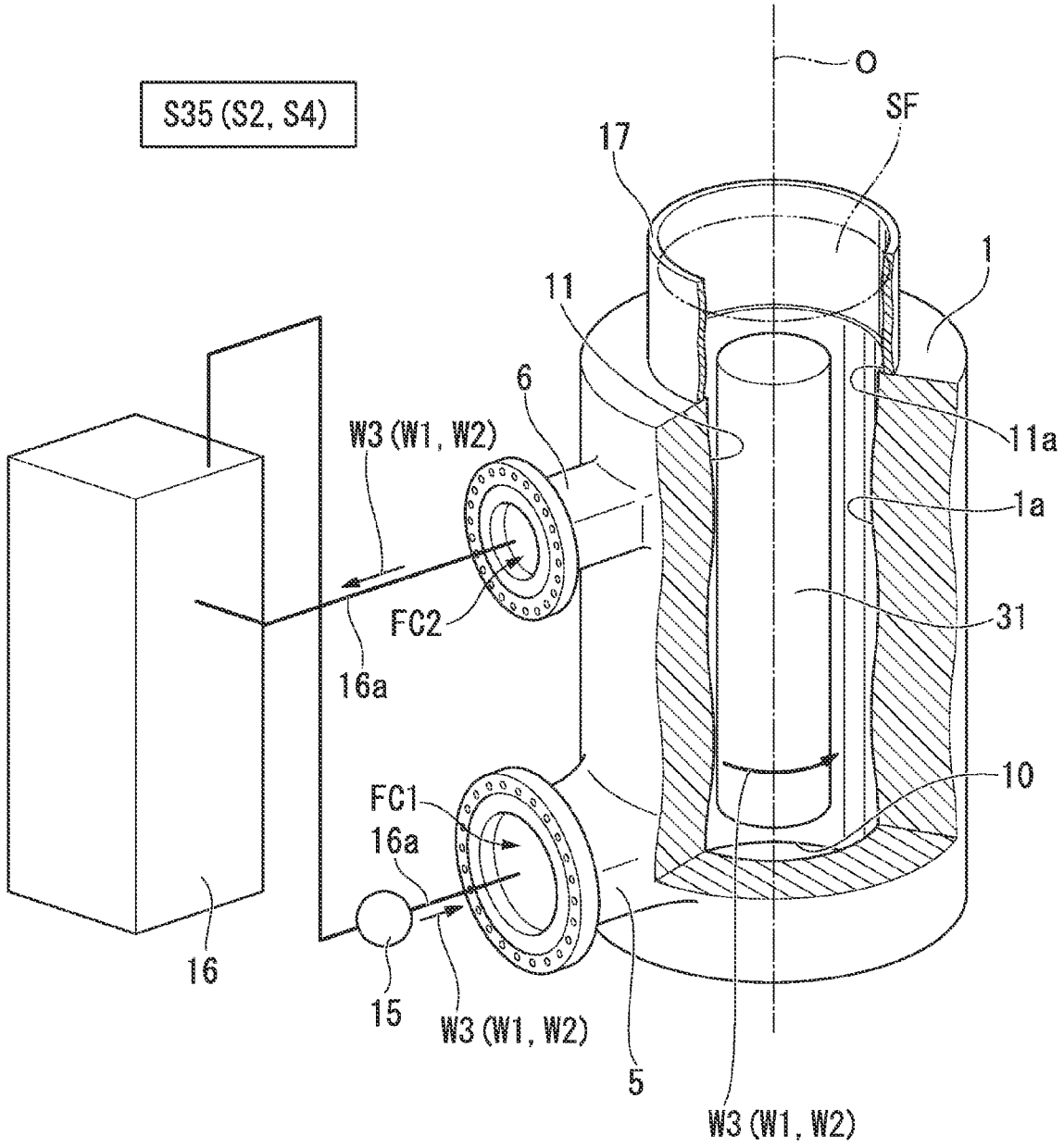
FIG. 5 is a perspective view illustrating an aspect of carrying out plating on a casing using a method of manufacturing a centrifugal compressor according to a third embodiment of the present invention.

As illustrated in FIG. 5, in the plating process S35, a core 31 of a columnar shape is provided by insertion from a downstream opening part 11 so as to have the same axis as a casing 1, i.e. in a state in which a central axis of the core 31 is identical to an axis O and the core 31 is spaced apart from an inner surface 1*a* of the casing 1, and plating work for the inner surface 1*a* of the casing 1 is performed.

According to the method of manufacturing the centrifugal compressor 100 of the present embodiment, the core 31 is inserted, so that an internal volume of the casing 1 can be reduced. For this reason, a supplied amount of a plating liquid W3 can be reduced, which leads reduction of costs. Further, the plating liquid W3 causes flowing between the core 31 and the inner surface 1*a* of the casing 1. For this reason, a flow channel when the plating liquid W3 circulates and flows in the casing 1 is reduced, and a flow can be made smooth. Therefore, a quality of plating can be improved.

Further, a space defined between the inner surface 1*a* of the casing 1 and the core 31 has a constant gap throughout the circumference in a radial direction of the axis O in order to provide the core 31 on the same axis as the casing 1. Accordingly, a flow velocity of the plating liquid W3 flowing through an interior of the casing 1 can be made uniform, and thus the quality of plating can be further improved.

The core 31 may not necessarily be provided on the concentric axis. If the core 31 is at least provided so as to reduce the internal volume of the casing 1, the supplied amount of the plating liquid W3 is reduced to enable cost reduction.

Further, the core 31 is rotated around the axis O or is caused to move up and down, and thereby the core 31 can be used as a stirring device. Hydrogen gas attached to the inner surface 1*a* of the casing 1 during the plating work is removed, and the quality of plating can be further improved.

Furthermore, the core 31 can be applied to the plating process S35 as well as a surface activating process S2, a preheating process S4, or a cleaning process S3. Thereby, the quality of plating can be further improved.

[Fourth Embodiment]

Next, a method of manufacturing a centrifugal compressor 100 according to a fourth embodiment of the present invention will be described.

The same components as in the first to third embodiments will be given the same numerals or symbols, and detailed description thereof will be omitted.

In the present embodiment, a plating process S45 is different from those of the first to third embodiments.

Figure 6:
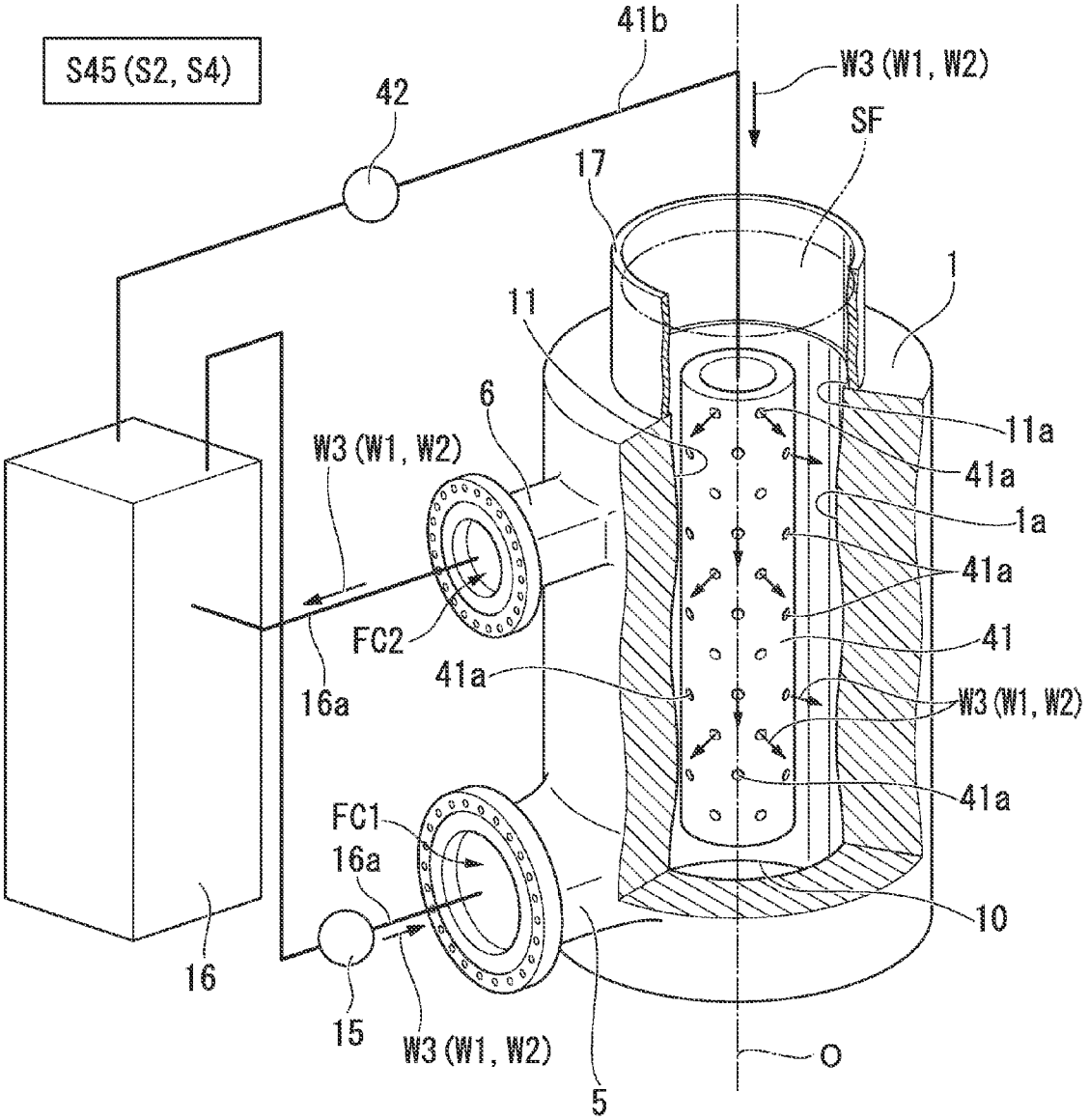
FIG. 6 is a perspective view illustrating an aspect of carrying out plating on a casing using a method of manufacturing a centrifugal compressor according to a fourth embodiment of the present invention.

As illustrated in FIG. 6, like the third embodiment, in the plating process S45, a core 41 with a cylindrical shape is provided so as to have the same axis as a casing 1, i.e. in a state in which a central axis of the core 41 is identical to an axis O. Further, the core 41 is provided by insertion from a downstream opening part 11 in a state in which the core 41 is spaced apart from an inner surface 1*a* of the casing 1, and plating work for the inner surface 1*a* of the casing 1 is performed.

Here, the core 41 is a hollow member, and an outer circumferential surface thereof is formed with multiple through-holes 41*a* so as to communicate with the interior and exterior of the core 41. The core 41 is connected to the tank 16 via a piping 41*b* and a pump 42. A plating liquid W3 is supplied into the core 41 during the plating work.

According to the method of manufacturing the centrifugal compressor 100 of the present embodiment, the core 41 is inserted, and the plating liquid W3 is supplied into the core 41. Thereby, the plating liquid W3 flows between the core 41 and the inner surface 1*a* of the casing 1. For this reason, a flow channel of the plating liquid W3 is reduced, and a flow can be made smooth. Further, since the plating liquid W3 can be ejected from the through-holes 41*a* toward the inner surface 1*a* of the casing 1, it is possible to obtain a stirring effect in the casing 1. Accordingly, it is possible to measure a uniform flow velocity of the plating liquid W3 in the casing 1, and to remove hydrogen gas attached to the inner surface 1*a* of the casing 1 during the plating work. Therefore, a quality of plating can be improved in the plating process S45.

The core 41 may not necessarily be provided on the concentric axis. The core 41 is rotated around the axis O or is caused to move up and down, and thereby the stirring effect can be further improved. The core 41 can be applied to the plating process S45 as well as a surface activating process S2, a preheating process S4, or a cleaning process S3.

[Fifth Embodiment]

Next, a method of manufacturing a centrifugal compressor 100 according to a fifth embodiment of the present invention will be described.

The same components as in the first to fourth embodiments will be given the same numerals or symbols, and detailed description thereof will be omitted.

In the present embodiment, a plating process S55 is different from those of the first to fourth embodiments.

Figure 7:
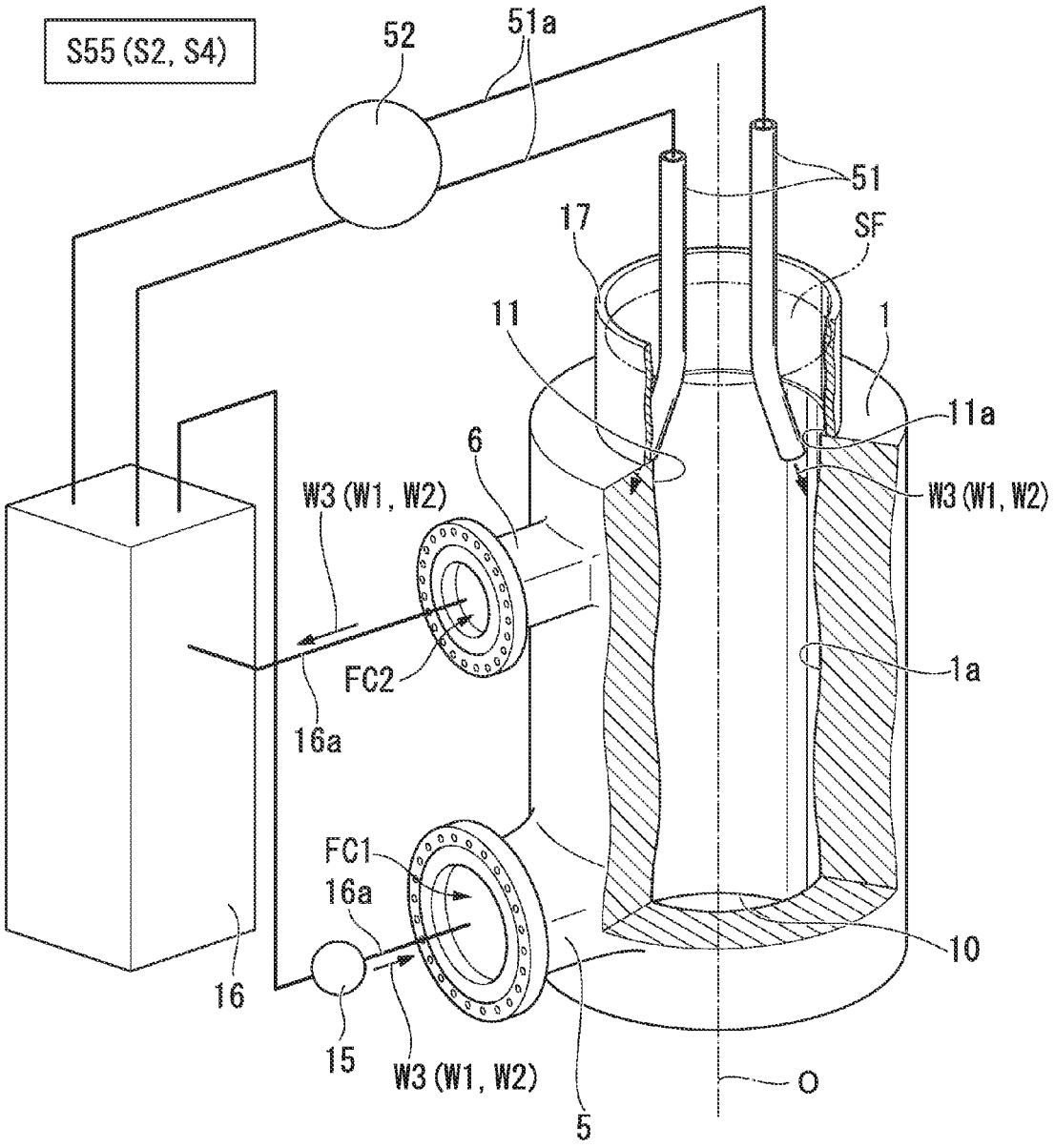
FIG. 7 is a perspective view illustrating an aspect of carrying out plating on a casing using a method of manufacturing a centrifugal compressor according to a fifth embodiment of the present invention.

As illustrated in FIG. 7, in the plating process S55, plating work for an inner surface 1*a* of a casing 1 is performed in a state in which plating supply hoses 51 acting as a stirring device are inserted from a downstream opening part 11.

Here, the plating supply hoses 51 are connected to a tank 16 via piping 51*a* and a pump 52. A plating liquid W3 is adapted to be supplied from an interior of the tank 16 into the casing 1.

According to the method of manufacturing the centrifugal compressor 100 of the present embodiment, the plating liquid W3 is supplied by the plating supply hoses 51 alongside the supply from an intake port 5. Thereby, it is possible to remove hydrogen gas attached to the inner surface 1*a* of the casing 1 during the plating work. Therefore, it is possible to prevent the plating work from being obstructed at portions at which the hydrogen gas is attached. For this reason, a quality of plating can be further improved in the plating process S55.

Particularly, when the casing 1 has a more complicated shape, a water stop region is formed at a corner portion such as a connection portion between the inner surface 1*a* of the casing 1 and an intake channel FC1 and between the inner surface 1*a* of the casing 1 and a discharge channel FC2. The plating liquid W3 is supplied from the plating supply hoses 51 at this position, and an effect of removing the hydrogen gas can be further improved.

The plating supply hoses 51 can carry out the plating process S55 as well as a surface activating process S2, a preheating process S4, or a cleaning process S3 using the same technique as in the present embodiment in which each liquid is supplied by the supply hoses. Thereby, the quality of plating can be further improved.

In the present embodiment, the plating supply hoses 51 are used as the stirring device. Instead of this, plating suction hoses suctioning the plating liquid W3 from the interior of the casing 1 can also be used.

[Sixth Embodiment]

Next, a method of manufacturing a centrifugal compressor 100 according to a sixth embodiment of the present invention will be described.

The same components as in the first to fifth embodiments will be given the same numerals or symbols, and detailed description thereof will be omitted.

In the present embodiment, a plating process S65 is different from those of the first to fifth embodiments.

Figure 8:
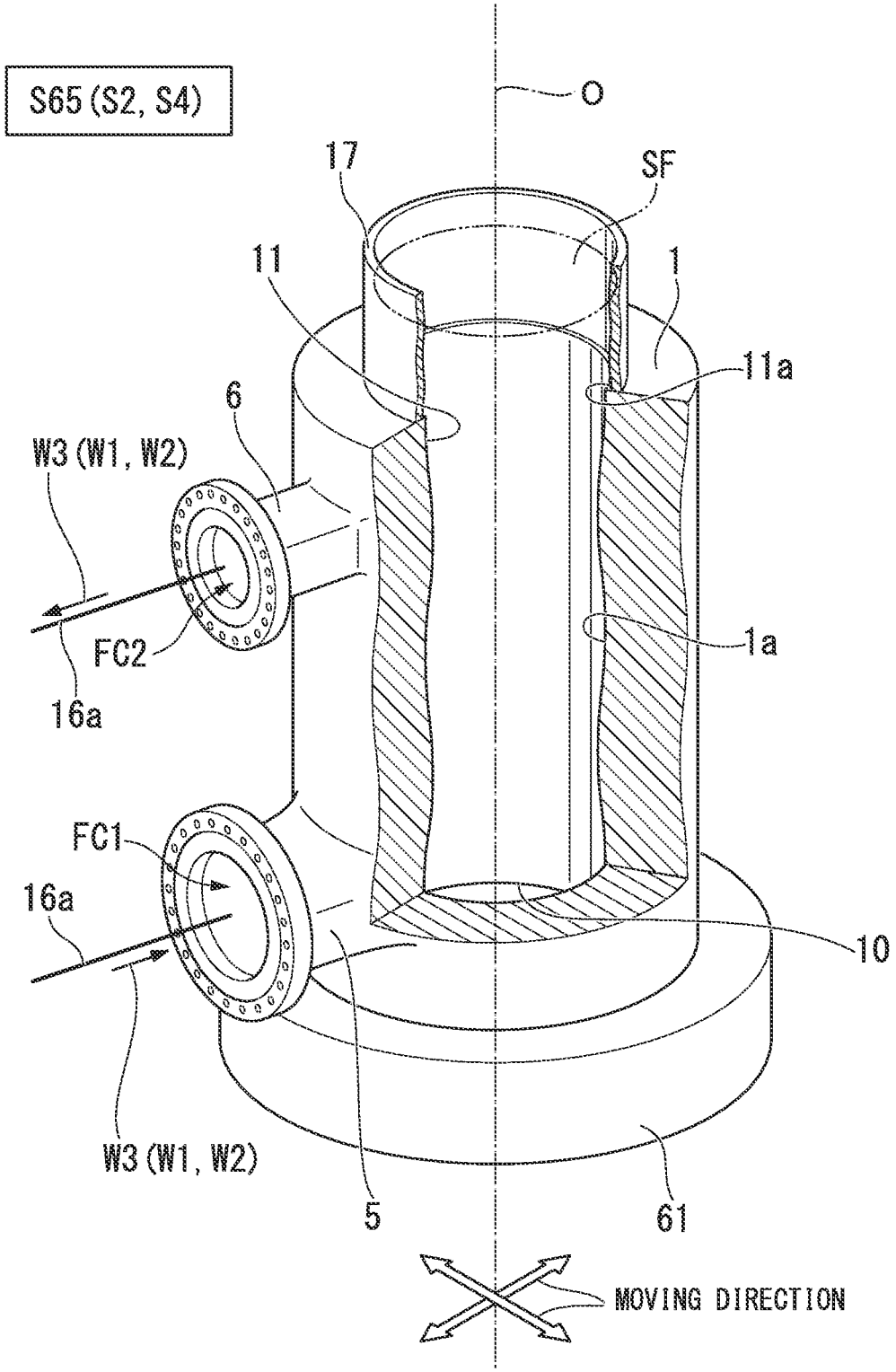
FIG. 8 is a perspective view illustrating an aspect of carrying out plating on a casing using a method of manufacturing a centrifugal compressor according to a sixth embodiment of the present invention.

As illustrated in FIG. 8, in the plating process S65, a mounting table 61 is provided as a vibration imparting device, and plating work is performed in a state in which a casing 1 is placed on the mounting table 61.

Here, the mounting table 61 has, for instance, an electric motor (not shown), and is a device that generates vibration in a horizontal direction, a vertical direction, and forward, backward, leftward, and rightward directions.

According to a method of manufacturing a centrifugal rotary machine of the present embodiment, vibration is imparted to the casing 1 by the mounting table 61 in a state in which a plating liquid W3 is stored in the casing 1. For this reason, it is possible to prevent stagnation of hydrogen gas that is generated during plating work and is attached to an inner surface 1*a* of the casing 1. Accordingly, a quality of plating can be further improved in the plating process S65.

Here, without using the mounting table 61 as the vibration imparting device, a technique of, for instance, directly striking the casing 1 may also be used.

Further, ultrasonic waves may also be imparted to the casing 1 using an ultrasonic generator (ultrasonic generating part) generating the ultrasonic waves as the vibration imparting device.

Furthermore, the vibration imparting device can be applied to the plating process S65 as well as a surface activating process S2, a preheating process S4, or a cleaning process S3. Thereby, the quality of plating can be further improved.

[Seventh Embodiment]

Next, a method of manufacturing a centrifugal compressor 100 according to a seventh embodiment of the present invention will be described.

The same components as in the first to sixth embodiments will be given the same numerals or symbols, and detailed description thereof will be omitted.

In the present embodiment, a plating process S75 is different from those of the first to sixth embodiments.

Figure 9:
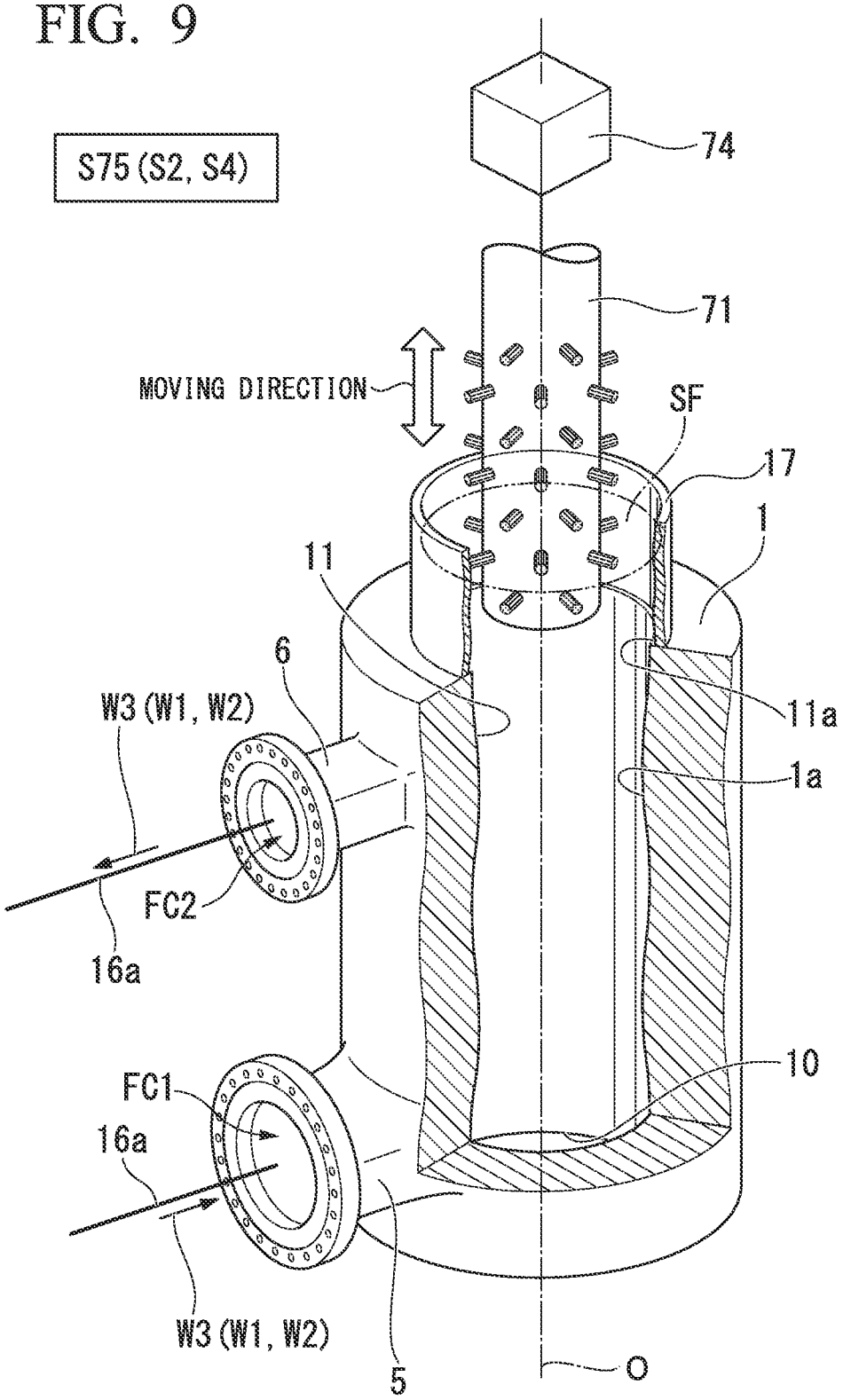
FIG. 9 is a perspective view illustrating an aspect of carrying out plating on a casing using a method of manufacturing a centrifugal compressor according to a seventh embodiment of the present invention.

As illustrated in FIG. 9, in the plating process S75, plating work is performed by a brush 71 inserted from a downstream opening part 11 while an inner surface 1*a* of a casing 1 is rubbed.

The brush 71 is shaped of a rod which extends in a direction of an axis O with multiple hairs being provided on an outer circumferential surface thereof, and is displaced up and down by a driving part 74 such as an electric motor. The driving part 74 may rotate the brush 71 around the axis O.

According to the method of manufacturing the centrifugal rotary machine of the present embodiment, in a state in which a plating liquid W3 is stored in the casing 1, the inner surface 1*a* of the casing 1 is rubbed by the brush 71. For this reason, it is possible to prevent stagnation of hydrogen gas that is generated during plating work and is attached to the inner surface 1*a* of the casing 1. Therefore, a quality of plating can be further improved in the plating process S75.

The brush 71 can be applied to the plating process S75 as well as a surface activating process S2, a preheating process S4, or a cleaning process S3. Thereby, the quality of plating can be further improved.

[Eighth Embodiment]

Next, a method of manufacturing a centrifugal compressor 100A according to an eighth embodiment of the present invention will be described.

The same components as in the first to seventh embodiments will be given the same numerals or symbols, and detailed description thereof will be omitted.

In the present embodiment, a casing 1A that is a target to be plated is different from those of the first to seventh embodiments. Further, a plating process S85 is different from those of these embodiments.

Figure 10A:
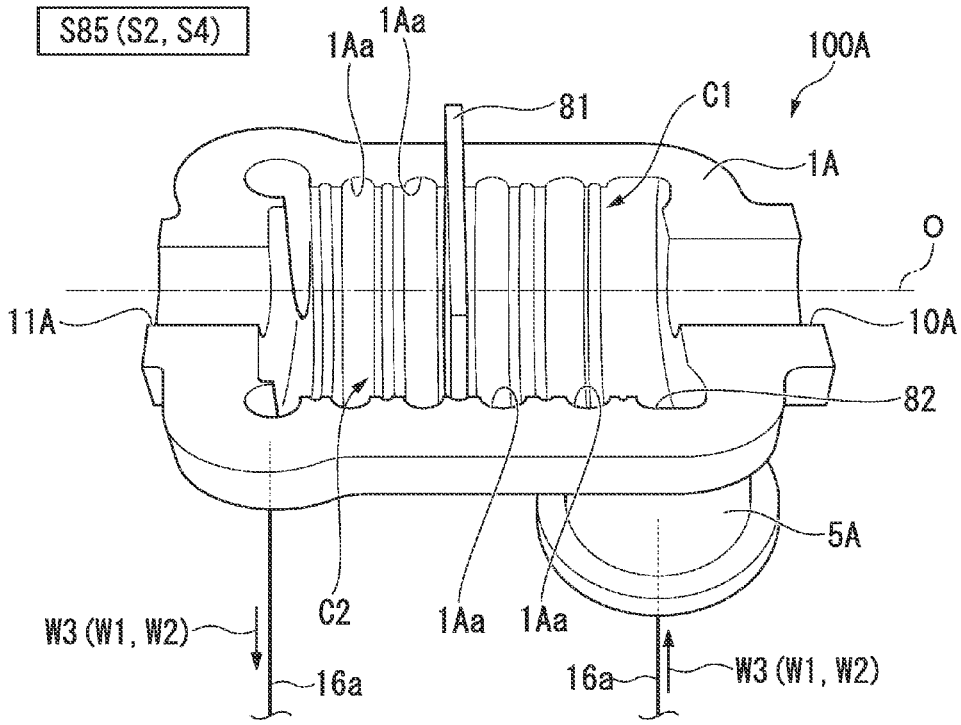
FIG. 10A is a view illustrating the aspect of carrying out the plating on the casing using the method of manufacturing a centrifugal compressor according to the fifth embodiment of the present invention when the casing is obliquely viewed from the inside.
Figure 10B:
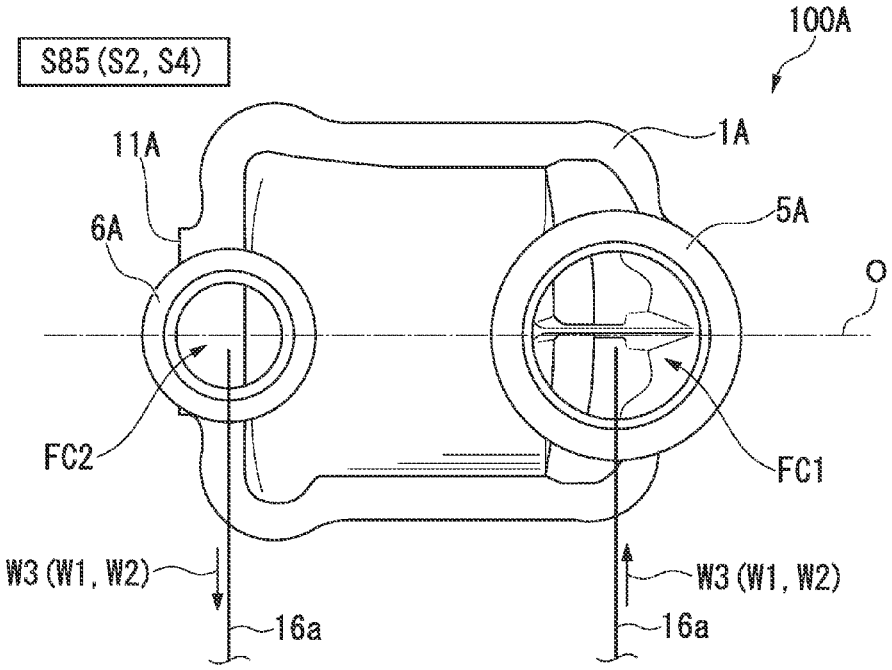
FIG. 10B is a view illustrating the aspect of carrying out the plating on the casing using the method of manufacturing a centrifugal compressor according to the fifth embodiment of the present invention when the casing is viewed from the outside.

As illustrated in FIGS. 10A and 10B, in the plating process S85, the casing 1A undergoing plating work is given as a horizontal division type that is divided into two parts so as to include an axis O.

In the plating process S85, the plating work is performed in a state in which the casing 1A is placed in a halved state such that the axis O becomes a horizontal direction, i.e., such that a direction in which an upstream opening part 10A and a downstream opening part 11A are open becomes a horizontal direction. At this point in time, a division-side opening part 82 of the casing 1A is placed upward. For this reason, among an intake port 5A, a discharge port 6A, the upstream opening part 10A, the downstream opening part 11A, and the division-side opening part 82 that are all opening parts in the casing 1, the largest opening part remains directed upward.

Further, in the plating process S85, plating work is performed in a state in which an interior of the casing 1A is partitioned into two spaces by a partition plate 81 shaped of a plate. To be specific, the partition plate 81 is provided between the intake port 5A and the discharge port 6A so as to be perpendicular to the axis O, and the partition plate 81 is sandwiched to partition the interior of the casing 1A into a first space C1 of one side in a direction of the axis O (right side in the space of FIG. 10A) and a second space C2 of the other side in the direction of the axis O.

The partition plate 81 is installed to be plugged into a groove 1Aa formed in the inner surface 1*a* of the casing 1A in a ring shape in a circumferential direction of the axis O. In this case, a gap may also be present between the inner surface 1*a* of the casing 1A and the partition plate 81.

In the plating process S85, the upstream opening part 10A and the intake port 5A communicate with the first space C1, and the downstream opening part 11A and the discharge port 6A communicate with the second space C2. That is, at least two opening parts communicate with each space.

According to the method of manufacturing the centrifugal compressor 100A of the present embodiment, the space in the casing 1A in which a plating liquid W3 circulates can be divided into the first space C1 and the second space C2. For this reason, the plating liquid W3 can flow through each space, and fluidity of the plating liquid W3 in the casing 1A can be improved compared to when the partition plate 81 is not provided. Therefore, a quality of plating can be improved.

In the present embodiment, the partition plate 81 can be applied to the plating process S85 as well as a surface activating process S2, a preheating process S4, or a cleaning process S3. Thereby, the quality of plating can be further improved.

Although preferred embodiments of the present invention have been described in detail, some design changes are also possible without departing from the technical idea of the present invention.

In the aforementioned embodiments, the cylindrical type of casing 1 has been described with regard to the first to seventh embodiments. However, the method of manufacturing the centrifugal compressor 100 in these embodiments may be applied to the horizontal division type of casing 1A described in the eighth embodiment. In this case, as illustrated in FIGS. 10A and 10B, the casing 1A is preferably placed in a halved state such that the division-side opening part 82 is directed upward.

Further, in the eighth embodiment, the horizontal division type of casing 1A has been described. However, the method of manufacturing the centrifugal compressor 100A in the eighth embodiment may be applied to the cylindrical type of casing 1 described in the first to seventh embodiments. In this case, the casing 1 is preferably placed such that the downstream opening part 11 or the upstream opening part 10 is directed upward.

Furthermore, the methods for manufacturing the centrifugal compressor 100 (100A) described in the first to eighth embodiments may be appropriately combined. For example, the stirring propeller 21 of the second embodiment may be combined with the mounting table 61 of the sixth embodiment.

Further, in the aforementioned embodiments, the centrifugal compressor 100 (100A) has been described, but the aforementioned manufacturing method may be applied to other rotary machines such as an axial compressor, a turbine, and so on.

INDUSTRIAL APPLICABILITY

According to the method of manufacturing the rotary machine, the method of plating the rotary machine, and the rotary machine, all of which are described above, the pretreatment liquid and the plating liquid are supplied and discharged using the opening parts formed in the casing, and thereby costs can be reduced, and the plating work for the casing can be done by a simple technique.

REFERENCE SIGNS LIST

1: casing
1*a*: inner surface
2: internal casing
3: rotary shaft (rotating body)
4: impeller (rotating body)
5: intake port (opening part)
6: discharge port (opening part)
10: upstream opening part
11: downstream opening part
11*a*: opening edge
15: pump
16: tank
16*a*: piping
17: cover member
100: centrifugal compressor (rotary machine)
O: axis
F: fluid
FC1: intake channel
FC2: discharge channel
S0: casing forming process
S1: preparing process
S2: surface activating process S3: cleaning process
S4: preheating process
S5: plating process
S6: casing finishing process
S7: assembling process
SF: liquid level
W1: pretreatment liquid
W2: preheating liquid
W3: plating liquid
S25: plating process
21: stirring propeller (stirring device)
22: body part
23: blade part
24: driving part
S35: plating process
31: core
S45: plating process
41: core
41*a*: through-hole
41*b*: piping
42: pump
S55: plating process
51: plating supply hose (stirring device)
51*a*: piping
52: pump
S65: plating process
61: mounting table (vibration imparting device)
S75: plating process
71: brush
74: driving part
1A: casing
1Aa: groove
5A: intake port
6A: discharge port
10A: upstream opening part
11A: downstream opening part
81: partition plate
82: division-side opening part
S85: plating process
C1: first space
C2: second space
100A: centrifugal compressor (rotary machine)

The invention claimed is:

1. A method of manufacturing a rotary machine comprising:

a casing forming process of forming a casing of the rotary machine that has multiple opening parts and suctions and discharges a fluid;

a surface activating process of supplying a pretreatment liquid into the casing, then discharging the pretreatment liquid from the casing through the opening parts, and activating an inner surface of the casing after the casing forming process;

a plating process of performing supply and discharge of a plating liquid into and from the casing through the opening parts to circulate the plating liquid and plating the inner surface of the casing after the surface activating process; and an assembling process of providing a rotating body that is rotatable relative to the casing so as to be covered from an outer circumference side by the casing plated in the plating process.

2. The method according to claim 1, further comprising a preheating process of supplying a preheating liquid into the casing, then discharging the preheating liquid from the casing through the opening parts, and preheating the casing between the surface activating process and the plating process.

3. The method according to claim 2, wherein the casing in the preheating process is preheated by a preheating liquid containing a reductant as the preheating liquid.

4. The method according to claim 1, wherein the plating liquid supplied into the casing in the plating process is stirred by a stirring device.

5. The method according to claim 1, wherein, in the plating process, the plating is performed in a state in which the opening part having a largest opening among the multiple opening parts is directed upward.

6. The method according to claim 1, wherein the plating liquid in the plating process is supplied and discharged from the opening part that requires plating work and suctions and discharges the fluid among the multiple opening parts.

7. The method according to claim 1, wherein, in the plating process, the plating is performed in a state in which a cover member surrounding an opening edge of the opening part from an outer circumference side is provided for the casing so as to cause the opening part opened upward among the multiple opening parts to further extend in an upward direction.

8. The method according to claim 1, wherein, in the plating process, the plating is performed after a core is installed in the casing in a state in which the core is spaced apart from an inner surface of the casing.

9. The method according to claim 8, wherein, in the plating process, a hollow member having through-holes that are formed in an outer circumferential surface thereof and communicate with an interior and exterior thereof is used as the core, and the plating liquid is supplied into the hollow member and is ejected from the through-holes toward an exterior of the hollow member.

10. The method according to claim 8, wherein, in the plating process, the plating is performed while moving the core.

11. The method according to claim 1, wherein, in the plating process, the plating is performed in a state in which a partition plate for partitioning an interior of the casing into multiple spaces in an extending direction of the casing is provided such that at least two of the opening parts communicate with the respective spaces.

12. The method according to claim 1, wherein, in the plating process, the plating is performed while vibration is imparted to the casing by a vibration imparting device.

13. The method according to claim 1, wherein, in the plating process, the plating is performed while the inner surface of the casing is being rubbed by a brush.

14. A method of plating a rotary machine, particularly an inner surface of a casing of the rotary machine that has multiple opening parts and suctions and discharges a fluid, the method comprising:

a surface activating process of supplying a pretreatment liquid into the casing, then discharging the pretreatment liquid from the casing through the opening parts, and activating an inner surface of the casing; and a plating process of performing supply and discharge of a plating liquid into and from the casing through the opening parts to circulate the plating liquid and plating the inner surface of the casing after the surface activating process.

* * * * *